United States Patent [19]

Stahlecker

[11] Patent Number: 4,590,756

[45] Date of Patent: May 27, 1986

[54] OPEN-END FRICTION SPINNING

[75] Inventor: Fritz Stahlecker, Josef-Neidhart-Strasse 18, 7347 Bad Uberkingen, Fed. Rep. of Germany

[73] Assignees: Hans Stahlecker; Fritz Stahlecker, Fed. Rep. of Germany

[21] Appl. No.: 761,683

[22] Filed: Aug. 2, 1985

[30] Foreign Application Priority Data

Aug. 10, 1984 [DE] Fed. Rep. of Germany ..... 3429513

[51] Int. Cl.[4] ..... D01H 1/135; D01H 7/882

[52] U.S. Cl. ..... 57/401; 57/334

[58] Field of Search ..... 57/400, 401, 334, 335

[56] References Cited

U.S. PATENT DOCUMENTS

| | | | |
|---|---|---|---|
| 4,168,601 | 9/1979 | Didek et al. | 57/401 |
| 4,202,163 | 5/1980 | Turk et al. | 57/401 |
| 4,380,892 | 4/1983 | Parker et al. | 57/401 |
| 4,420,928 | 12/1983 | Fehrer | 57/401 |
| 4,522,022 | 6/1985 | Parker et al. | 57/401 |
| 4,537,021 | 8/1985 | Parker | 57/401 |

*Primary Examiner*—Donald Watkins

*Attorney, Agent, or Firm*—Barnes & Thornburg

[57] ABSTRACT

An open-end friction spinning machine is provided having two adjacently arranged rollers that are drivable in the same rotational direction and form a wedge-shaped gap serving as a yarn formation zone. A fiber feeding device forms a scatter zone in which fibers scattered over a limited area of the axial length of the rollers are fed to the wedge-shaped gap. In the scatter zone, the rollers have sections with surfaces resulting in different frictional effects. Additionally, the sections of the two rollers that are opposite one another have different frictional effects. This difference in frictional effects between oppositely disposed roller sections can be used to create forces which either maintain forming yarn in the wedge-shaped gap during a yarn forming operation, or displace formed yarn from the wedge-shaped gap after a yarn forming operation.

11 Claims, 5 Drawing Figures

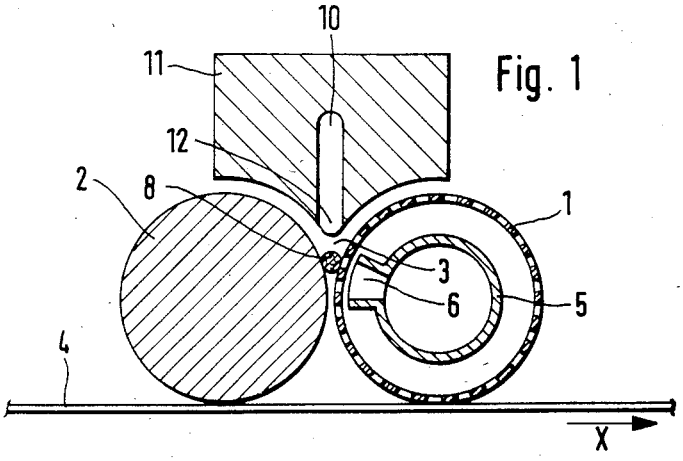
Fig. 1
Fig. 2
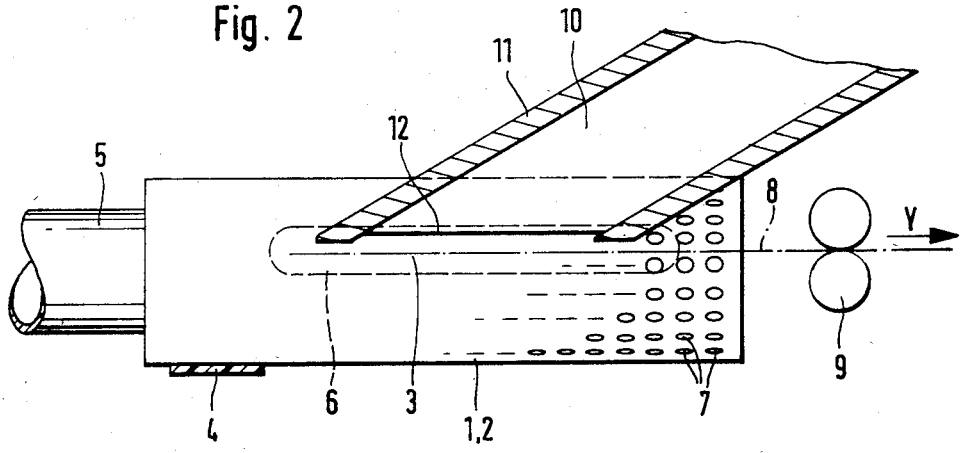

Fig. 3
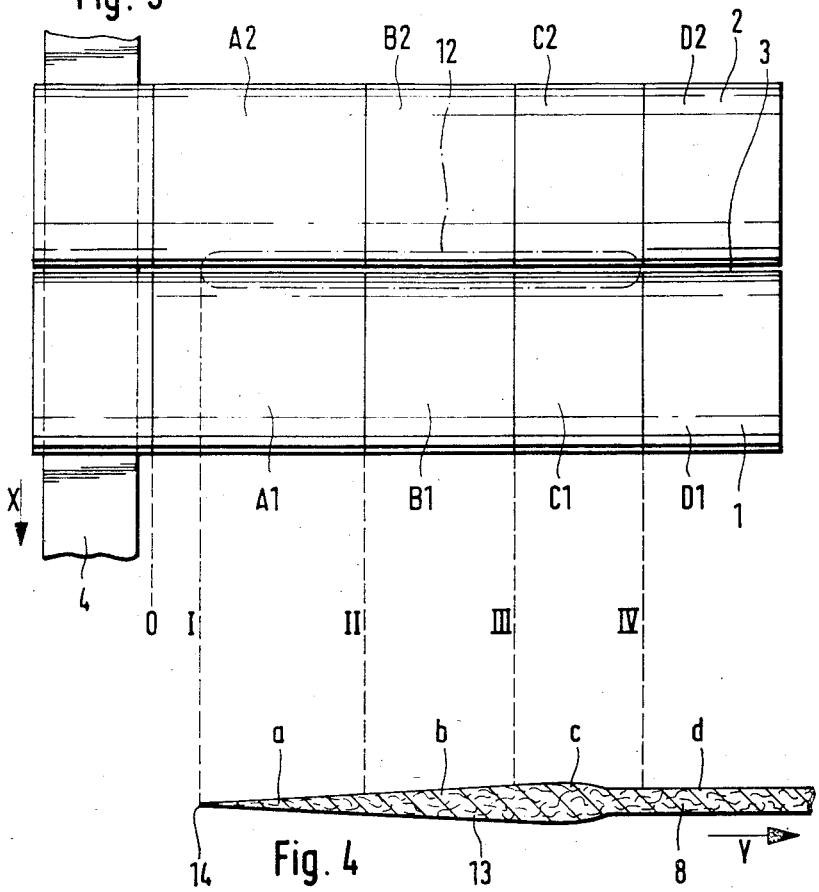
Fig. 4
Fig. 5
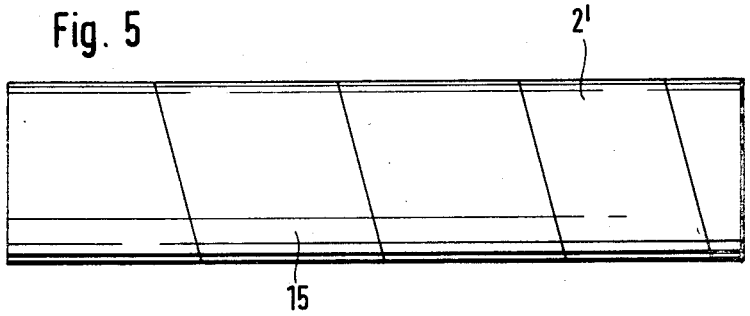

OPEN-END FRICTION SPINNING

BACKGROUND AND SUMMARY OF THE INVENTION

This invention relates to an arrangement for open-end friction spinning having two rollers serving as friction surface means that are arranged adjacent one another, are drivable in the same rotational direction and form a wedge-shaped gap serving as a yarn formation zone. At least one suction device operates in the area of the wedge-shaped gap, and a feeding device feeds fibers scattered over a limited range of the axial length of the rollers into a scatter zone along the wedge-shaped gap. A withdrawal device withdraws the formed yarn in a longitudinal direction along the wedge-shaped gap. In the scatter zone, along the axial direction of the rollers, sections are provided that have a varying frictional effect, in accordance with the disclosure of German Patent Application No. P 33 21228.7.

According to German Patent Application No. P 33 21228.7 an improvement of the spinning conditions, and thus an improvement of the quality of the spun yarn, can be achieved by the fact that the frictional effect of the rollers is adapted to the forming state of the yarn and is predetermined to suitable values.

The present invention has as one objective, further improving the spinning conditions and thus achieving an improvement of the spun yarn.

This objective is achieved by providing that the sections of the two rollers that are opposite one another have different surface qualities that result in different frictional effects. As a result, especially in the area of the start of the point of the yarn, the yarn formation can be influenced. It also becomes possible to prevent the fibers that are not yet tied up very well from being carried out of the area of the wedge-shaped gap. This contributes significantly to the fact that in the area of the start of the point of the yarn, the fibers cannot leave the wedge-shaped gap with the roller rotating out of the gap.

In a further development of the invention, it is provided that the sections of the rollers assigned to the start of the point of the forming yarn have a surface quality with the relatively lowest frictional effect. This design prevents the start of the yarn point which contains only relatively few fibers from being twisted together too much.

In a further development of the invention, it is provided that the center sections of the rollers have a surface quality within the relatively highest frictional effect. As a result, a high frictional effect exists in that area in which a substantial amount of the final twist is applied to the yarn.

In a further development of the invention, it is provided that the section of the roller rotating out of the wedge-shaped gap that is last in the moving direction of the yarn, has a surface quality that has a higher frictional effect relative to the preceding section of this roller. As a result, in this area in which the already spun yarn is present, a component of force leading out of the wedge-shaped gap is generated so that the yarn can be withdrawn more easily and an excessive false twist is avoided.

In a further development of the invention, it is provided that the surfaces of at least one of the rollers at least in the area of the scatter zone are spark-eroded in order to produce indicated surface qualities. By means of this treatment process of the metallic rollers, a surface structure can be produced that has a precisely determined roughness and thus a precisely determined frictional effect. It will thus be possible to produce the desired surface qualities in the individual sections in a reproducible manner.

Other objects, advantages and novel features of the present invention will become apparent from the following detailed description of the invention when considered in conjunction with the accompanying drawings.

BRIEF DESCRIPTION OF THE DRAWINGS

FIG. 1 shows a cross-section through an arrangement for an open-end friction spinning in accordance with the present invention;

FIG. 2 shows a longitudinal section in the plane of the wedge-shaped gap;

FIG. 3 shows a diagrammatic top view of two rollers forming a wedge-shaped gap;

FIG. 4 shows an enlarged diagrammatic representation of the point of a yarn forming in the area of the scatter zone in the wedge-shaped gap between the two rollers; and FIG. 5 shows another embodiment in accordance with the present invention wherein the rollers exhibit spiral sections of varying frictional effect.

DETAILED DESCRIPTION OF THE DRAWINGS

The arrangement for open-end friction spinning illustrated in FIGS. 1 to 3 includes two rollers 1 and 2 that are arranged adjacent one another in parallel and together form a wedge-shaped gap 3 in which yarn 8 is spun. The rollers 1 and 2 are driven in the same rotational direction, for example, by means of a tangential belt 4 moving along directly against the cylindrical outer surfaces of the rollers 1 and 2. The tangential belt 4 moves through a machine in the direction of the Arrow X. The machine contains a plurality of identically designed arrangements for open-end friction spinning, and the same tangential belt 4 drives all rollers 1 and 2 of the arrangements located on one side of the machine. Because of the moving direction X of the tangential belt 4 which moves along (on the side facing away from the wedge-shaped gap 3 containing the fibers) against the cylindrical outer surfaces of the rollers 1 and 2, roller 1 rotates into the wedge-shaped gap while roller 2 rotates out of the wedge-shaped gap.

Roller 1 is designed as a suction roller. Its surface is provided with perforations 7. A suction tube 5 is disposed inside roller 1. Roller 1, designed as a cylindrical shell, is mounted on suction tube 5 by means of roller bearings in a manner that is not shown in detail. The suction tube 5 is connected to a vacuum source that is not shown. The suction tube 5 also has a longitudinal slot 6 extending in parallel to the wedge-shaped gap 3 and directed toward the gap. By means of the suction tube 5 and the longitudinal slot 6, air current is generated that flows into the roller 1 through the perforations 7. This air current has the purpose of holding the forming yarn 8 in the wedge-shaped gap 3 and also causing the transport of the fibers to the wedge-shaped gap 3. In the case of one embodiment, the roller 2 is designed as a solid roller, i.e., it has a closed cylindrical surface. It is also contemplated that the roller 2 be designed as a suction roller that is designed as a mirror image of roller 1.

A fiber feeding duct 10 disposed in the plane of the wedge-shaped gap 3 and formed in a partial housing 11 leads into the area of the wedge-shaped gap 3 by means of a mouth 12. The mouth 12 of the fiber feeding duct 10 is designed to be slot-shaped and extends in a longitudinal direction along the wedge-shaped gap at a short distance from the wedge-shaped gap 3. The mouth 12, in the longitudinal direction of the wedge-shaped gap 3, forms a scatter zone in which the individual fibers are fed and reach the outer surfaces of the roller 1 and 2 in the area of the wedge-shaped gap 3. The length of the scatter zone (mouth 12) determines the length of the yarn point 13 (FIG. 4). The start 14 of the yarn point 13 is located approximately where the mouth 12 begins. The yarn point 13 changes into the yarn 8 that has substantially its final form at about the point where the mouth 12 ends.

The spun yarn 8 is withdrawn along the longitudinal direction of the wedge-shaped gap 3 in the direction of the Arrow Y by means of a withdrawal device. This withdrawal device comprises a pair of withdrawal rollers 9. The yarn then reaches a wind-up device (not shown in detail) in which it is wound on to a spool. In FIG. 4, the forming yarn 8 is shown diagrammatically in the area of its yarn point 13. It is drawn in parallel to the wedge-shaped gap formed by the rollers 1 and 2 of FIG. 3. By means of the interrupted lines I, II, III and IV between FIGS. 3 and 4, relationships are established with the scatter zone formed by the mouth 12 in the area of the wedge-shaped gap 3. The point or tip 13 of the yarn is diagrammatically divided into three sections a, b and c, followed by a section d. This division into the sections a, b and c is to be understood only diagrammatically, because in reality, flowing transitions exist instead of such rigid divisions. Sections A1, A2, B1, B2, C1, C2 and D1, D2 on the surfaces of the rollers 1 and 2 correspond to Sections (or areas) a, b, c and d of the yarn tip 13. Sections A1 and A2 in this case extend over the borderline I to a line) which goes slightly beyond the start 14 of the yarn tip 13 in a direction opposite the withdrawal direction Y. In these sections, the two rollers 1 and 2 have differently constructed surfaces by means of which a correspondingly different frictional effect is exercised on the yarn tip 13 in the sections a, b and c and also in section d in which the yarn 8 has practically received its final shape and twist.

The twist should be relatively soft in area "a" of the yarn tip 13. For this reason, a relatively slight frictional effect is established in this area by adopting the quality of the surfaces of the rollers 1 and 2 in sections A1 and A2. Advantageously, it is provided in this case that the frictional effect caused by the surface in section A1 of the roller 1 rotating into the wedge-shaped gap 3 is at least somewhat higher than the frictional effect exercised by the surface of section A2 of roller 2. As a result, the fibers existing in area "a" in a relatively small number, if possible, are not drawn out of the wedge-shaped gap by the roller 2 rotating out of it. At the same time, in the area "a" the yarn tip 13 is twisted only relatively softly.

The relatively strongest frictional effect on the yarn tip 13 is to be exerted in area b. The surfaces of sections B1 and B2 of the rollers 1 and 2 are designed correspondingly. In this case, it may also be provided that the frictional effect of section B1 which rotates into the wedge-shaped gap 3 is higher than the frictional effect of section B2. In area c, the surface condition of sections C1 and C2 is selected in such a way that the frictional effect on the yarn tip 13 is somewhat less than in area b, but higher than in area "a". In area d, i.e., in the area of the wedge-shaped gap 3 following the scatter zone (mouth 12) in the withdrawal direction of the yarn, the yarn 8 has practically received its final form. The surface condition of sections D1 and D2 of rollers 1 and 2 is therefore adjusted in such a way that the frictional effect is higher than in area "a" but lower than in areas b and c. Advantageously, it is provided in this case that the surfaces of rollers 1 and 2 in sections D1 and D2 differ from one another, so that they exercise a different frictional effect on the yarn 8 in the area d. In this case, it is provided that the surface condition of section D2 of the roller rotating out of the wedge-shaped gap 3 results in a much higher frictional effect than the surface condition in section D1. Because of the therefore disproportionately higher frictional effect, the formed yarn 8 in area d is at least slightly lifted out of the wedge-shaped gap 3.

For roller 1, the surface quality is therefore predetermined in such a way that in section A1 there is a relatively slight frictional effect, in section B1 there is a frictional effect that is as high as possible, in section C1 there is still a relatively high frictional effect and in section D1 there is a moderate frictional effect. In the case of roller 2, it is provided, on the other hand, that in section A2 there is a very slight frictional effect (less than in section A1 of roller 1), in section B2 there is a fairly high frictional effect, in section C2 there is a medium frictional effect and in section D2 there is a high frictional effect.

It should be added that in FIG. 3, sections A to D are divided by lines. Naturally, it is possible to avoid suddenly changing the frictional effect between the sections. Instead it is comtemplated that a steady transition be designed over a certain range of the length of the rollers 1 and 2 between sections A to D.

In the case of the embodiment according to FIG. 5, the roller 2' rotating out of the wedge-shaped gap is divided into individual sections 15 surrounding the surface of the roller 2' in the form of spiral bands. The frictional effect, by a corresponding design of the surface within the spiral band, is changed continuously in accordance with the recommendations concerning the preceding embodiments. By means of this spiral arrangement, a certain axial thrust can be exerted on the yarn 8 and the yarn tip 13 in the withdrawal direction Y.

The desired frictional roller surface may be produced, for example, by the prior art method of spark-eroding the surface of metallic rollers. This process is used on the surface of at least one of the rollers and at least in the region of the scatter zone. The spark erosion treatment produces a surface structure having a precisely determined roughness which causes a precisely determined frictional effect. Thus, reproducible friction effect differentials are produced between adjacent sections of an individual roller (A., B., C., D.) or between corresponding sections of the two adjacently arranged rollers ($A_1$, $A_2$; $B_1$, $B_2$; $C_1$, $C_2$; $D_1$, $D_2$).

Although the invention has been described and illustrated in detail, it is to be clearly understood that the above is to be taken by way of illustration and example only and not by way of limitation. The spirit and scope of the invention are to be limited only by the terms of the appended claims.

What is claimed is:

1. An open-end friction spinning machine having two adjacently arranged friction rollers drivable in the same rotational direction and forming a wedge-shaped yarn-forming gap, said rollers having a plurality of axial sections exhibiting different frictional effects, said sections of each said roller disposed opposite one another having differing surface characteristics yielding different frictional effects.

2. An open-end friction spinning machine according to claim 1, wherein at least one suction means for drawing fiber material into said wedge-shaped gap is disposed adjacent said wedge-shaped gap.

3. An open-end friction spinning machine according to claim 1, including feeding device means for feeding fibers to said wedge-shaped gap and scattering fibers along said wedge-shaped gap adjacent an axial segment of said rollers, said feeding device means forming a scatter zone adjacent said wedge-shaped gap.

4. An open-end friction spinning machine according to claim 1, including withdrawal device means for withdrawing formed yarn in a longitudinal direction along said wedge-shaped gap.

5. An open-end friction spinning machine according to claim 1, wherein each said roller exhibits a yarn tip forming section and a yarn finishing section, one said roller being rotatable into said wedge-shaped gap, and the other said roller being rotatable out of said wedge-shaped gap, said yarn tip forming section of said roller rotatable into said wedge-shaped gap having a surface yielding a greater frictional effect than said yarn tip forming section of said roller rotatable out of said wedge-shaped gap.

6. An open end friction spinning machine according to claim 1, wherein corresponding sections of said rollers are arranged staggered with respect to one another along an axial direction of said rollers.

7. An open end friction spinning machine according to claim 5, wherein said yarn tip forming section comprises a yarn tip starting region exhibiting a surface characteristic yielding a minimum frictional effect relative to other sections of said rollers.

8. An open end friction spinning machine according to claim 7, wherein said yarn tip forming section comprises a center section having a surface characteristic yielding a maximum frictional effect relative to other sections of said rollers.

9. An open end friction spinning machine according to claim 5, wherein said yarn tip forming section comprises a yarn tip finishing section, said yarn tip finishing section of said roller rotatable out of said wedge-shaped gap having a surface characterisitic yielding a frictional effect smaller than a frictional effect yielded by a surface characteristic of said yarn finishing section.

10. An open end friction spinning machine according to claim 1, wherein said rollers have spark eroded surfaces for producing predetermined surface characteristics.

11. An open end friction spinning machine according to claim 1, wherein said sections of each said roller comprise sections of a spiral pattern on each said roller.

* * * * *